United States Patent [19]

Russell

[11] 4,397,515

[45] Aug. 9, 1983

[54] CENTER CONDUCTOR ELEMENT FOR FEMALE MICROWAVE COAXIAL CONNECTOR

[75] Inventor: Thomas J. Russell, Sunnyvale, Calif.

[73] Assignee: Krytar, Inc., Santa Clara, Calif.

[21] Appl. No.: 243,815

[22] Filed: Mar. 16, 1981

Related U.S. Application Data

[63] Continuation of Ser. No. 97,734, Nov. 26, 1979.

[51] Int. Cl.[3] ..... H01R 17/18

[52] U.S. Cl. ..... 339/177 R; 339/298 R

[58] Field of Search ..... 339/177 R, 177 E, 256 R, 339/258 R, 258 A

[56] References Cited

U.S. PATENT DOCUMENTS

| | | | |
|---|---|---|---|
| 3,253,250 | 5/1966 | Harrison et al. | 339/177 R |
| 3,286,222 | 11/1966 | Drinkwater | 339/258 R |
| 3,792,419 | 2/1974 | Spinner | 339/177 R |
| 4,291,936 | 9/1981 | Oldfield et al. | 339/177 R |

*Primary Examiner*—Eugene F. Desmond

*Attorney, Agent, or Firm*—Harvey G. Lowhurst

[57] ABSTRACT

An improved center conductor element for a miniature female, air dielectric, coaxial connector that has two concentric tubes, one of which is the inner and shorter tube and the other is the outer and longer tube. The inner shorter tube engages the pointed end of the male pin and provides for centering of the mating male pin, and the longer outer tube is slotted to form fingers which make contact, at their ends, with the male pin.

5 Claims, 11 Drawing Figures

CENTER CONDUCTOR ELEMENT FOR FEMALE MICROWAVE COAXIAL CONNECTOR

This application is a continuation of application Ser. No. 09/097,734, filed Nov. 26, 1979.

BACKGROUND OF THE INVENTION

This invention relates to a new improved center conductor female element for a miniature female coaxial connector.

Present day requirements in microwave systems and components are leading to the continually increasing use of higher and higher frequencies for coaxial microwave systems and components. In order to provide mode free performance at these higher frequencies, it has been necessary to make connectors physically smaller. The commonly used SMA connector is an example of a minature coaxial connector that can be used at higher microwave frequencies. The SMA is a sexed connector that is usable to 26 GHz.

Recently, a new high performance 3.5 mm sexed coaxial connector, commonly known as the APC-3.5 and manufactured by the Amphenol Division of Bunker Ramo, has been introduced that gives mode free performance to 34 GHz, see S. F. Adam, G. R. Kirkpatrick, N. J. Sladek, S. T. Bruno, "A High Performance 3.5 mm Connector to 34 GHz," Microwave Journal, Vol. 19, No. 7, July 1976. The APC-3.5 is a coaxial connector pair comprising a male and female connector, each element of which is compatible with the standard type SMA connector now commonly used. Unlike the SMA, the APC-3.5 is an air dielectric connector. That is, in the vicinity of the male-female center conductor connection, air is the dielectric in the region between the center conductor and outer conductor.

The APC-3.5 was designed to provide improved electrical performance, mechanical ruggedness, and reliability to the type SMA. It does provide improved electrical performance. However, the female connector has been found to have an unacceptably high failure rate with repeated usage. This is caused by both mechanical distortion and failure of the center conductor female element. The APC-3.5 female element is slotted to provide four fingers that are resiliently biased toward each other so that, when the male pin of the mating connector is inserted, positive contact is made at the ends of the fingers. When failure occurs, the cause is usually found to be that at least one of the female fingers is not making contact, at its end, with the male pin. This causes undesirable electrical reflections which typically become severe, or resonate, at frequencies above 10 GHz.

The failure mechanism can be explained as follows: Due to nominal design clearances and dimensional tolerances, there can be quite a bit of play or "slop" in the mating of APC-3.5 and SMA connectors. This play allows the SMA or APC-3.5 male connector pin to engage either off center or at an angle with respect to the APC-3.5 female element. The APC-3.5 connector has outer and inner conductor diameters of 0.138 inch (3.5 mm) and 0.060 inch respectively which make the female element fingers too fragile (approx. 0.011 inch thick) to forcibly center the mating male pin. Either of the situations is illustrated in FIGS. 1 and 2 of the drawing herein and can cause one or more of the female element fingers to be deflected as shown, and not make contact at their ends with the male pin. Once a female element finger has been distorted, as illustrated in FIGS. 1 or 2 of the drawing, it will usually not make contact, at its end, on later connections even though the male and female elements are centered. This is because severe deflections take the fingers past the point where they can recover and spring back to their original position. This type of female element failure does not occur in the SMA female connector because the female element of the SMA connector is surrounded by a plastic dielectric (typically teflon) that prevents the fingers from being distorted outwardly as shown in FIGS. 1 and 2 of the drawing.

One solution to the female element failure problem for miniature air dielectric coaxial connectors was proposed by Wiltron Co. and is described in an article entitled "Connector Relieves Nagging SMA Measurement Problems" Microwaves, Vol. 18, No. 1, January 1979, pp. 97–99. As described, the female element consists of two concentric tubes, with the inner tube slotted, to form fingers which are biased to make contact with both the outer tube and the mating male pin. The outer tube is unslotted and prevents the fingers from being distorted outward by an off-center male pin. However, this solution is not entirely satisfactory since the female element is difficult and costly to manufacture, requiring extremely tight dimensional tolerances and complicated twisted biasing of the fingers.

SUMMARY OF THE PRESENT INVENTION

It is an object of the present invention to provide a center conductor female element for a miniature female air dielectric coaxial connector that has improved reliability and mechanical ruggedness.

It is a further object of the present invention to provide a center conductor female element for a miniature female, air dielectric, coaxial connector that is simple in design, readily manufacturable, and provides electrical performance that is free of resonances (mode free) and minimizes reflections for frequencies in excess of 26 GHz.

It is still a further object of the present invention to provide a center conductor female element that is compatible with the APC-3.5 and the SMA and similar male coaxial connectors, and improves the reliability and mechanical ruggedness of the resulting connector with no degradation in electrical performance.

In accordance with the present invention, the center conductor female element is provided with two concentric tubes, one being the shorter inner tube which engages and centers the mating male pin, and other being the longer outer tube which is slotted to form electrical contact fingers which extend past the end of the inner tube and are resiliently biased inwardly to radially contact, at their ends, the male pin.

DETAILED DESCRIPTION OF THE DRAWINGS

Figure 1:
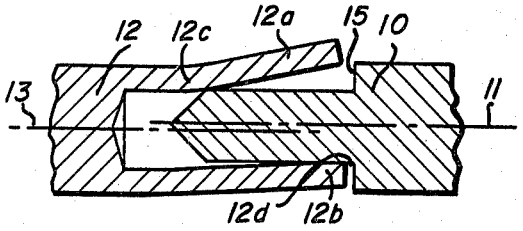
Fig 1 PRIOR ART
FIG. 1 is a cross sectional view of the engaging male and female elements of an APC-3.5 connector illustrating an off center male pin and the resulting deformation of the female part upon engagement.
Figure 2:
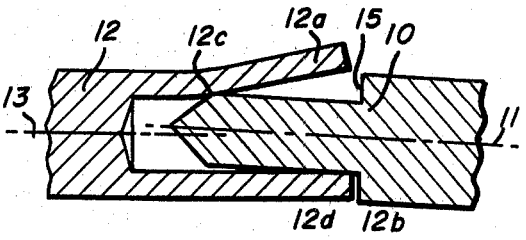
Fig 2 PRIOR ART
FIG. 2 is a cross sectional view of the engaging male and female elements of an APC-3.5 connector illustrating a male pin at an angle with the center line of the female and the resulting deformation of the female part upon engagement.
Figure 9:
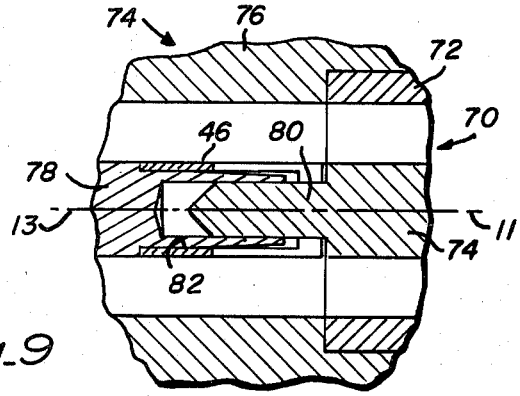
FIG. 9 is a cutaway view of an air dielectric coaxial connector utilizing the male and female elements shown in FIG. 3.

Referring now to the drawings, and particularly to FIGS. 1 and 2 thereof, there is shown a male portion 10 having a center line 11 and female portion 12 having a center line 13 which, respectively, form the male and female ends of the center conductor at a junction of an ultra-high frequency coaxial connector. As is well known in the art, and as will be explained in connection with the description of FIG. 9, the usual coaxial connector has a male connector unit and a female connector unit, each having an outer conductive shell and an inner center conductor insulatively supported within the outer shell. The outer shells are normally connected by being butted together as shown in FIG. 9, and form no part of this invention. The ends of the center conductor, shown in FIGS. 1 and 2, are connected by sliding the male portion 10 into the female portion 12.

FIG. 1 illustrates the problem attendant when the male pin is off center, i.e. center lines 11 and 13 are parallel but not coincident, and FIG. 2 illustrates the problem attendant when the male pin is at an angle with respect to the center line, i.e. center lines 11 and 13 are at an angle with respect to one another. As a result, contact finger 12*a* is forced outwardly so that contact takes place only at 12*c*, and finger 12*b* is allowed to flex inwardly and make contact only at 12*d*. In both cases, the contact between the male and female parts is not at the ends of the fingers and near to the shoulders 15, as it should be.

Such a failure of the fingers to make contact, at their ends, with the male pin causes undesirable reflections. Also, the severe deflection of finger 12*a* will often cause it to fail mechanically and take a permanent "set".

Misalignment of the male pin with the female element as in FIGS. 1 or 2 illustrates the prior art problem which could only be solved by either the complicated female element proposed by the Wiltron Co. or by modifying the connector design and tightening mechanical tolerances to allow for less "play" during connection and consequently less misalignment of the female element with the male pin. Modifying the APC-3.5 connector design and tightening its mechanical tolerances is not always desirable because of increased cost and also because the APC-3.5 would no longer be compatible with the standard SMA connector.

Referring now to FIGS. 3 through 8, which illustrate the present invention, there is shown a center conductor terminating in male portion 20 which is mated with the center conductor terminated in a female portion 22. The terminating portion of male portion 20 is of conventional construction and has a cylindrical male element 24 of a uniform main diameter and a cylindrical forward portion 26 of a first reduced diameter which terminates in a tapered point 28. The junction between the two diameters forms a first annular radial shoulder 30.

The terminating female portion 22 includes a cylindrical female element 32 which has a tubular forward portion 34 of a second reduced external diameter and has an internal diameter 36 selected to slidingly receive cylindrical forward portion 26. The junction between the two diameters forming a second annular radial shoulder 38. The external surface of tubular forward portion 34 has a cylindrical section 40 and a tapered section 42.

Figure 3:
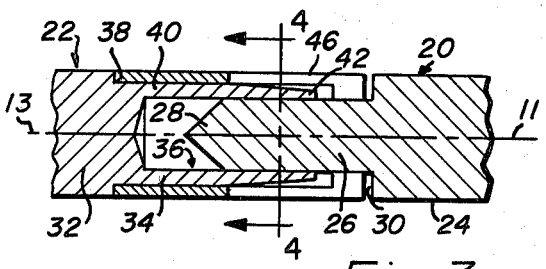
FIG. 3 is a cutaway cross sectional view of the female element of the present invention engaged with a mating male pin.
Figure 4:
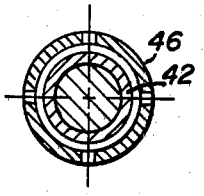
FIG. 4 is a view taken along lines 4—4 of FIG. 3.

There is further provided a tubular contact finger sleeve 46 which has an external diameter equal to the uniform main diameter of cylindrical male element 20 and cylindrical female element 22, and has an internal diameter 48 which is selected to slidingly fit over cylindrical section 34 of female element 22. Sleeve 46 is provided with four lengthwise slots 50 which extend about half way along the entire length of sleeve 46 and which form four flexible spring fingers which, as best seen in FIG. 3, are substantially coextensive with tapered section 42 of female element 22 and extend beyond it. In this manner, the fingers can be inwardly biased, the tapered section providing the space therefor. The fingers, designated by reference character 52, are provided with inwardly extending contact segments 54 which make contact with cylindrical forward portion 26 of male portion 20.

In the preferred embodiment of the invention, sleeve 46 is made of heat treated beryllium-copper to provide good spring action. Also, contact segments 54 are formed by leaving a reduced diameter at the spring end of sleeve 46 prior to providing slots 50. Sleeve 46 is placed on reduced diameter section 40 of female element 32 after a small amount of solder paste has been deposited on section 40 near shoulder 38. The sleeve is put flush with annular shoulder 38, and element 32 and sleeve 46 are heated until the solder flows joining sleeve 46 permanently to female element 32. Sleeve 46 could also be press fitted or welded in place on element 32. For best results the entire female element 22 is gold plated.

Referring to FIG. 3, it can be seen that the tubular portion 34 provides primarily for the centering of male cylindrical portion 26 with respect to tubular contact finger sleeve 46, thus preventing reflections and mechanical failure of finger sleeve 46.

Referring now to FIG. 9, there is shown a cutaway view of an air dielectric coaxial connector constructed in accordance with the present invention. A male connector unit 70 comprises an outer shell 72 and a center conductor 74 insulative supported within the outer shell, and a female connector 75 comprises an outer shell 76 and a center conductor 78 insulatively supported within the outer shell. Center conductor 74 is terminated in the conventional male portion 80 which is in all respects similar to male portion 20 shown in FIG. 3, and center conductor 78 is terminated in a female portion 82 which in all respects is similar to the one shown in FIG. 3 as 22. Female portion 22 is provided with tubular contact finger sleeve 46 to effect a good high-frequency connection which has a minimum of reflection and therefore only a minimal VSWR varient.

Figure 10:
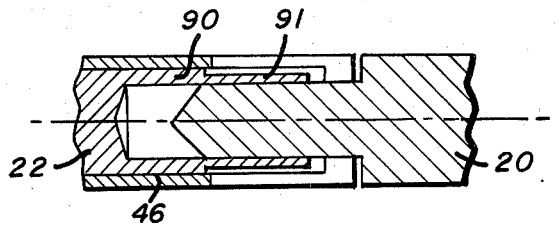
FIG. 10 is a cutaway cross sectional view like FIG. 3 but showing an alternative embodiment of the inner centering tube of FIG. 5.

FIG. 10 shows an alternate embodiment of tubular portion 34 in which a tubular extension 90 is provided which has a reduced diameter portion 91 instead of the tapered portion 42. The purpose is the same, namely to allow spring fingers 46 to be inwardly biased for good electrical contact with male element 20.

Figure 5:
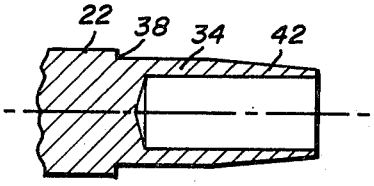
FIG. 5 is a cutaway cross sectional view of the inner centering tube of the present invention.
Figure 6:
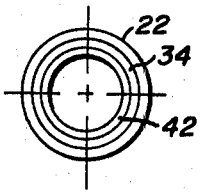
FIG. 6 is an end view of the inner centering tube of FIG. 5.
Figure 7:
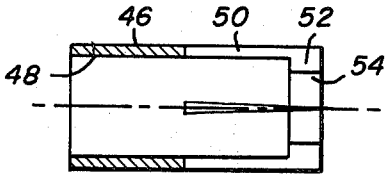
FIG. 7 is a cross sectional view of the outer slotted contact tube of the present invention.
Figure 8:
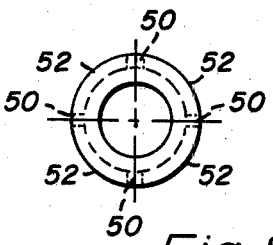
FIG. 8 is an end view of the outer tube of FIG. 7.
Figure 11:
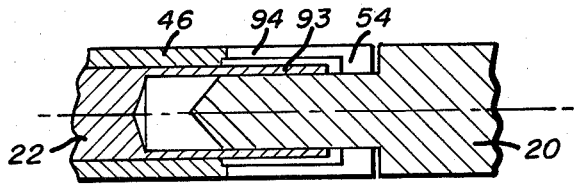
FIG. 11 is a cut away cross sectional view like FIG. 3 but showing an alternate embodiment of both inner and outer tubes.

FIG. 11 shows a further alternate embodiment of tubular portion 34 and of sleeve 46 in which a tubular extension 93 is provided which is of uniform radial thickness along its length, i.e. is neither tapered as in FIG. 5 nor has a reduced diameter end portion as in FIG. 10. Further, sleeve 46 is provided with an enlarged internal tubular potion proximate to contact segments 54 to allow contact fingers 52 to be inwardly biased for good electrical contact with male portion 20.

In all the illustrated embodiments of this invention, the female portion 22 is provided with a forwardly extending tubular extension for mechanically or structurally receiving and centering the male pin, and a sleeve with inwardly biased contact fingers for electrically contacting the male pin.

There has been described a center conductor element for a female coaxial connector having two concentric tubes with the inner tube providing for centering of the mating male pin, and the outer tube being slotted to form fingers which extend past the end of the inner tube and are biased inwardly to cause contact points at their ends to radially contact the male pin.

What is claimed is:

1. In an ultra-high frequency coaxial connector for frequencies above 18 GHz, in which a male connector unit and a female connector unit, each having an outer conductive shell and a center conductor of substantially the same external uniform diameter insulatively supported within the outer shell, are connected to one another, and in which the ends of the center conductors terminate in male and female portions, and in which the male portion has a cylindrical forward portion of a first reduced diameter terminating in a tapered point, the junction between the two diameters forming a first annular radial shoulder, the improvement in the female portion comprising:

a cylindrical female element having an integral tubular forward portion of a second reduced external diameter and an internal diameter selected to slidingly receive the cylindrical forward portion of said male element, the junction between the two diameters forming a second annular radial shoulder, said external surface of said tubular forward portion having a cylindrical section commencing at said second annular shoulder and a tapered section terminating at the end of said tubular forward portion; and a tubular contact finger sleeve of said uniform diameter for its external surface and having an internal diameter which is selected to slidingly fit over said tubular forward portion, said sleeve terminating in a plurality of spring fingers which are coextensive with said tapered section and extend beyond the end of said tubular forward portion, said fingers being located and biased and shaped so as to conductively contact the cylindrical forward portion of said male element proximate said first annular shoulder when said male and female elements are mated, said tapered section allowing said fingers to be inwardly spring biased for a good electrical contact with the cylindrical forward portion of said male element.

2. In an ultra-high frequency coaxial connector for frequencies above 18 GHz, in which a male connector unit and a female connector unit each having an outer conductive shell and a center conductor insulatively supported within the outer shell are connected to one another, and in which at least the ends of the inner center conductors are cylindrical and have substantially the same external uniform diameter and terminate in male and female portions, and in which the male portion has a cylindrical forward portion of a reduced diameter terminating in a tapered point, the improvement in the female portion comprising:

a cylindrical female element having an integral tubular forward portion of a reduced external diameter and an internal diameter selected to slidingly receive the cylindrical forward portion of said male element, said external surface of said tubular forward portion having a cylindrical section and tapered section terminating at the end of said tubular forward portion; and a tubular contact finger sleeve having a substantially uniform external diameter equal to the external uniform diameter of said center connector and an internal diameter which is selected to slidingly fit over said tubular forward portion, said sleeve terminating in a plurality of spring fingers which are coextensive with said tapered section and extend beyond the end of said tubular forward portion, said fingers being located and biased and shaped to conductively contact the cylindrical forward portion of said male element when said male and female elements are mated.

3. In an ultra-high frequency coaxial connector in accordance with claim 2 in which the ends of said fingers have inwardly extending contact extensions for contacting said cylindrical forward portion.

4. In an ultra-high frequency coaxial connector in accordance with claim 3 in which said contact extensions lie on a cylindrical surface having a diameter which is less than the diameter of the cylindrical forward portion of said male element.

5. In an ultra-high frequency coaxial connector for frequencies above 18 GHz, in which a male connector unit and a female connector unit each having an outer conductive shell and a center conductor insulatively supported within the outer shell are connected to one another, and in which at least the ends of the inner center conductors are cylindrical and have substantially the same external uniform diameter and terminate in male and female portions, and in which the male portion has a cylindrical forward portion of a reduced diameter terminating in a tapered point, the improvement in the female portion comprising:

a cylindrical female element having an integral tubular forward portion of a reduced external diameter and an internal diameter selected to slidingly receive the cylindrical forward portion of said male element, the external surface of said tubular forward portion having a cylindrical section and a further section terminating at the end of said tubular forward portion, said further section having a further reduced diameter; and a tubular contact finger sleeve having a substantially uniform external diameter equal to the external uniform diameter of said center connector and an internal diameter which is selected to slidingly fit over said cylindrical section of said tubular forward portion, said sleeve terminating in a plurality of spring fingers which are coextensive with said further section and extend beyond the end of said tubular forward portion, said fingers being located and biased and shaped to conductively contact the cylindrical forward portion of said male element when said male and female elements are mated.

* * * * *